US005454690A

United States Patent [19]

Wolfe et al.

[11] Patent Number: 5,454,690

[45] Date of Patent: Oct. 3, 1995

[54] AIR FLOW HOUSING

[75] Inventors: Melvin E. Wolfe, Jr., Trout Run; Scott G. Smith, Muncy, both of Pa.

[73] Assignee: Shop Vac Corporation, Williamsport, Pa.

[21] Appl. No.: 180,686

[22] Filed: Jan. 13, 1994

[51] Int. Cl.[6] ..... F04D 29/66

[52] U.S. Cl. ..... 415/119; 415/210.1; 415/208.2; 417/423.2; 417/423.8

[58] Field of Search ..... 415/119, 195, 415/211.2, 210.1, 208.2; 417/366, 423.2, 423.8

[56] References Cited

U.S. PATENT DOCUMENTS

| | | | |
|---|---|---|---|
| 562,020 | 6/1896 | Peabody . | |
| 918,894 | 4/1909 | Noe . | |
| 1,441,955 | 1/1923 | Walker . | |
| 2,360,211 | 10/1944 | Doughman | 415/119 |
| 2,462,518 | 2/1949 | MacCracken | 415/208.2 |
| 2,915,237 | 12/1959 | Galiulo et al. | 417/423.2 |
| 2,982,986 | 5/1961 | Tupper . | |
| 2,987,241 | 6/1961 | Lindsjo et al. . | |
| 3,000,038 | 9/1961 | Heavner . | |
| 3,006,603 | 10/1961 | Caruso et al. . | |
| 3,398,866 | 8/1968 | La Flame et al. . | |
| 3,465,523 | 9/1969 | Clark, Jr. . | |
| 3,609,946 | 10/1971 | Nakagawa et al. . | |
| 3,731,465 | 5/1973 | Ohira et al. . | |
| 4,065,233 | 12/1977 | Torigoe et al. | 417/423.2 |
| 4,088,424 | 5/1978 | Hyatt et al. . | |
| 4,226,575 | 10/1980 | Hyatt et al. . | |
| 4,543,041 | 9/1985 | French et al. . | |
| 4,547,927 | 10/1985 | Berfield . | |
| 4,586,214 | 5/1986 | Berfield . | |
| 4,621,991 | 11/1986 | Smith et al. . | |
| 4,642,841 | 2/1987 | Berfield et al. . | |
| 4,669,952 | 6/1987 | Forsyth, III et al. . | |
| 4,684,835 | 8/1987 | Kline, Jr. et al. . | |
| 4,698,534 | 10/1987 | Smith et al. . | |
| 4,800,312 | 1/1989 | Wacek et al. . | |
| 4,859,144 | 8/1989 | Houston . | |
| 4,879,483 | 11/1989 | Barahia . | |
| 4,881,871 | 11/1989 | Wunderlich . | |
| 4,883,982 | 11/1989 | Forbes et al. . | |
| 4,971,520 | 11/1990 | Van Houten . | |
| 5,000,660 | 3/1991 | Van Houten et al. . | |
| 5,026,251 | 6/1991 | Kinoshita et al. . | |
| 5,028,826 | 7/1991 | Kitamura . | |
| 5,049,770 | 9/1991 | Gaeth et al. . | |
| 5,110,266 | 5/1992 | Toyoshima et al. | 417/423.2 |
| 5,143,513 | 9/1992 | Ellingson et al. . | |

FOREIGN PATENT DOCUMENTS

| | | | |
|---|---|---|---|
| 30905 | 3/1977 | Japan | 415/211.2 |
| 109799 | 8/1980 | Japan | 415/119 |
| 138496 | 10/1981 | Japan | 415/119 |
| 280700 | 11/1989 | Japan | 415/119 |
| 78600 | 4/1991 | Japan | 417/366 |

*Primary Examiner*—Edward K. Look
*Assistant Examiner*—James A. Larson
*Attorney, Agent, or Firm*—Marshall, O'Toole, Gerstein, Murray & Borun

[57] ABSTRACT

A housing for directing air propelled by an impeller through an object such as a motor has several arcuate vanes which direct the air radially inward towards ports associated with each vane. The vanes of the housing are placed non-symmetrically about the housing, and each vane has a corresponding vane located 180° around the housing. Sharp corners are eliminated on the back of each vane where the vane meets a main body, where each vane meets an outer rim and/or where each vane meets a base portion of the housing. The disclosed housing increases efficiency in moving air while decreasing the noise of the airflow.

25 Claims, 4 Drawing Sheets

AIR FLOW HOUSING

BACKGROUND OF THE INVENTION

The present invention relates generally to devices for directing airflow to an object and, more particularly, to devices for directing air propelled by an impeller through a housing and into a motor.

BACKGROUND ART

An impeller for moving air, such as may be used in a vacuum cleaner, is often enclosed within a housing which directs air downstream from the impeller as exhaust or for particular uses. For instance, if the impeller is driven by an electric motor, it may be desirable to direct the air moved by the impeller through the interior of the motor for cooling. The design of such a housing, including any vanes which might be used to direct the air, is of critical importance. A properly designed housing can add not only to the efficiency of the system in moving air and increasing air pressure, but can also minimize noise caused by the air flow.

Several patents disclose air directing elements of air moving systems having vanes with uncommon shapes in an effort to increase efficiency or reduce noise. U.S. Pat. No. 4,669,952 discloses a quiet by-pass vacuum motor having a fan end bracket with separating wedges or members which extend from an outer wall to an inner wall and define passageways to exhaust openings. Each wedge has what appears to be a generally radiused curve near the inner wall which flattens out towards the outer wall. The portion of the wedge near the outer wall is thickened as compared to the portion of the wedge near the inner wall.

U.S. Pat. No. 4,859,144 discloses a motor fan system having a non-rotatably mounted interstage and afterstage. Circumferential portions of the vane walls of the interstage and afterstage are turned relative to inner portions such that the walls of the circumferential portions face axially and the inner portions face radially. Junctions between the inner portions of the vanes and a base wall form sharp corners.

In addition to stationary vanes within housings, several patents disclose unusually shaped vanes on impellers or other moving parts. For instance, U.S. Pat. No. 3,398,866 discloses an impeller for a dishwasher pump where the vanes of the impeller are spaced unequally about the impeller. Similarly, U.S. Pat. No. 3,006,603 discloses irregularly spaced blades on a turbine. However, these patents do not disclose or suggest that the vanes may be stationarily disposed within a housing.

SUMMARY OF THE INVENTION

In accordance with one aspect of the present invention, a housing for directing air to an object has a main body portion including a first plurality of ports spaced about a periphery thereof and an outer rim surrounding the main body portion. A base portion extends between the main body portion and the outer rim. A second plurality of vanes is carried on the base portion and each vane extends from the outer rim to one of the ports on the periphery of the main body portion wherein the vanes are spaced in a non-symmetric fashion about the main body portion.

The housing may have an even number of vanes and each vane has a corresponding vane located 180° around the housing. There may be eight vanes on the housing.

Each vane has a port-facing side and the port-facing side may be curved to direct air towards the port adjacent the vane. The port-facing side of each vane may intersect the base portion at a right angle. The port-facing side of each vane may also be nearly tangent to the rim where the port-facing side of the vane extends to the rim.

Each vane has a back-facing side which intersects the main body with a curved surface. The back-facing side may intersect the outer rim with a curved surface and may intersect the base portion with a curved surface to direct air away from the back-facing side.

Further, the outer rim may intersect the base portion with a curved surface to direct air away from the rim and the vanes may be formed integrally with the main body portion, the base portion and the outer rim.

Still further, the housing may be used in combination with a foam ring placed adjacent the vanes.

In accordance with another aspect of the invention, a housing has a main body portion including a first plurality of ports spaced about a periphery thereof, an outer rim surrounding the main body portion and a base portion extending between the main body portion and the outer rim. A second plurality of vanes is carried on the base portion and each vane extends from the outer rim to one of the ports on the periphery of the main body portion. Each vane has a port-facing side, which is curved to direct air towards the port adjacent the vane, and the port-facing side of each vane is nearly tangent to the rim in the area where the port-facing side of the vane extends to the rim.

In accordance with another aspect of the present invention, a housing has a main body portion including a first plurality of ports spaced about a periphery thereof, an outer rim surrounding the main body portion and a base portion extending between the main body portion and the outer rim. A second plurality of vanes is carried on the base portion and each vane extends from the outer rim to one of the ports on the periphery of the main body portion wherein each vane has a port-facing side which intersects the base portion at a right angle. Each vane has a back-facing side and the back-facing side intersects the main body with a curved surface.

In accordance with yet another aspect of the present invention, a housing has a main body portion including a first plurality of ports spaced about a periphery thereof, an outer rim surrounding the main body portion and a base portion extending between the main body portion and the outer rim. A plurality of vanes is carried on the base portion and each vane extends from the outer rim to one of the ports on the periphery of the main body portion wherein each vane has a back-facing side which intersects the outer rim with a curved surface.

In accordance with still another aspect of the present invention, a housing has a main body portion including a plurality of ports spaced about a periphery thereof, an outer rim surrounding the main body portion and a base portion extending between the main body portion and the outer rim. A second plurality of vanes is carried on the base portion and each vane extends from the outer rim to one of the ports on the periphery of the main body portion wherein the vanes are spaced in a non-symmetrical fashion about the main body portion. Each vane has a port-facing side and a back-facing side wherein the port-facing side is curved to direct air towards the port adjacent the vane. The port-facing side of each vane also intersects the base portion at a right angle and is nearly tangent to the rim in the area where the port-facing side of the vane extends to the rim. The back-facing side intersects the main body, the outer rim and the base portion with curved surfaces. The outer rim intersects the base portion with a curved surface to direct air away from the rim.

DESCRIPTION OF THE PREFERRED EMBODIMENTS

Figure 1:
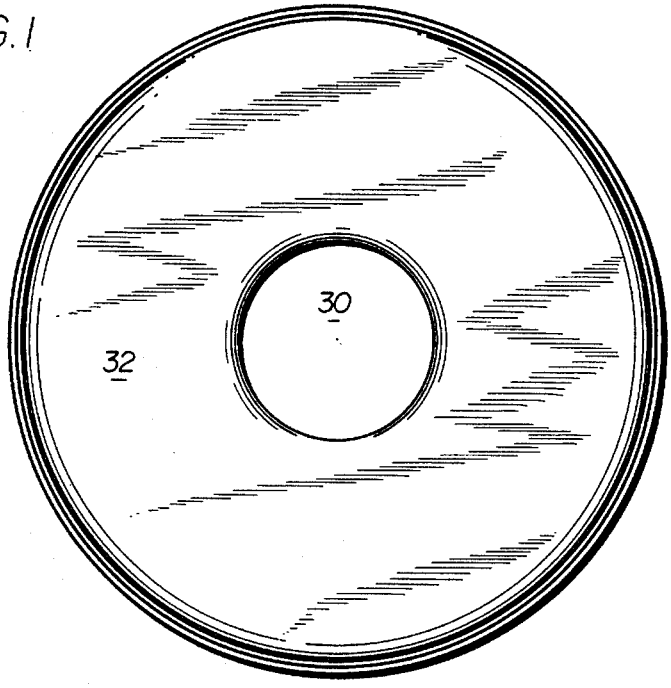
FIG. 1 is a bottom view of a motor assembly incorporating the motor housing of the present invention.
Figure 2:
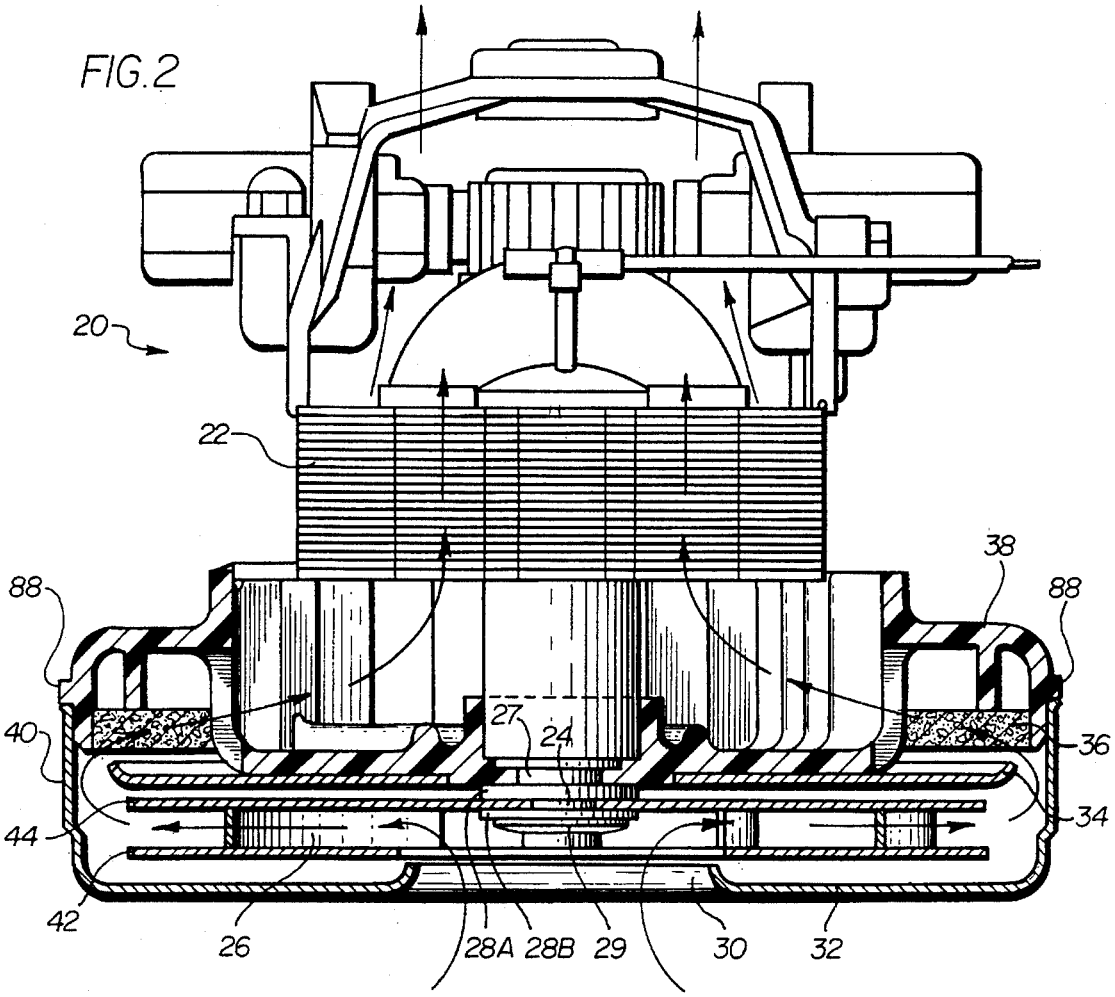
FIG. 2 is a side elevational view, partially in section, of the motor assembly of FIG. 1.

Referring initially to FIGS. 1 and 2, a motor assembly indicated generally at 20 has a motor 22 that rotates a drive shaft 24. The drive shaft 24 is connected to an impeller 26 by a spacer 27, washers 28A and 28B and a nut 29. The impeller 26 draws air through an opening 30 in a lower housing 32 (FIG. 1) and directs the air radially outward. Air directed by the impeller 26 flows around the outside of a baffle plate 34 through a foam ring 36 and into an upper housing 38. As will be discussed further below, air in the upper housing 38 is directed radially inward by features of the upper housing 38 and into the motor 22. The air may be used to cool the motor 22 and comprise working air for a dry vacuum cleaner.

Figure 5:
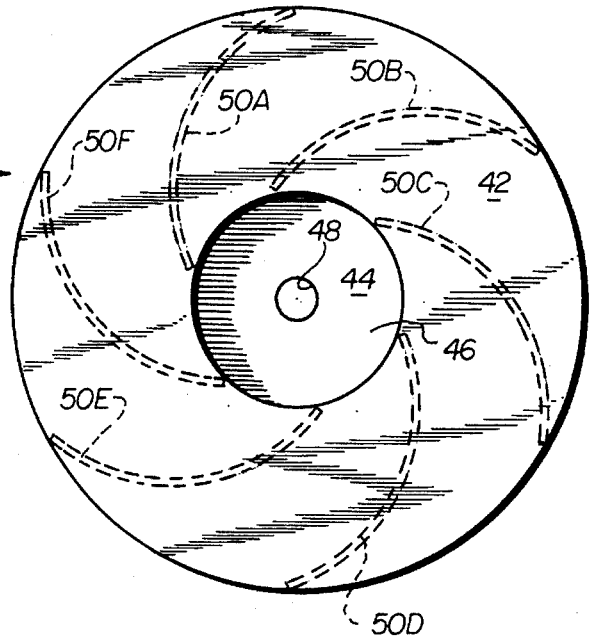
FIG. 5 is a bottom view of the impeller of FIG. 2., shown partially in phantom.
Figure 8:
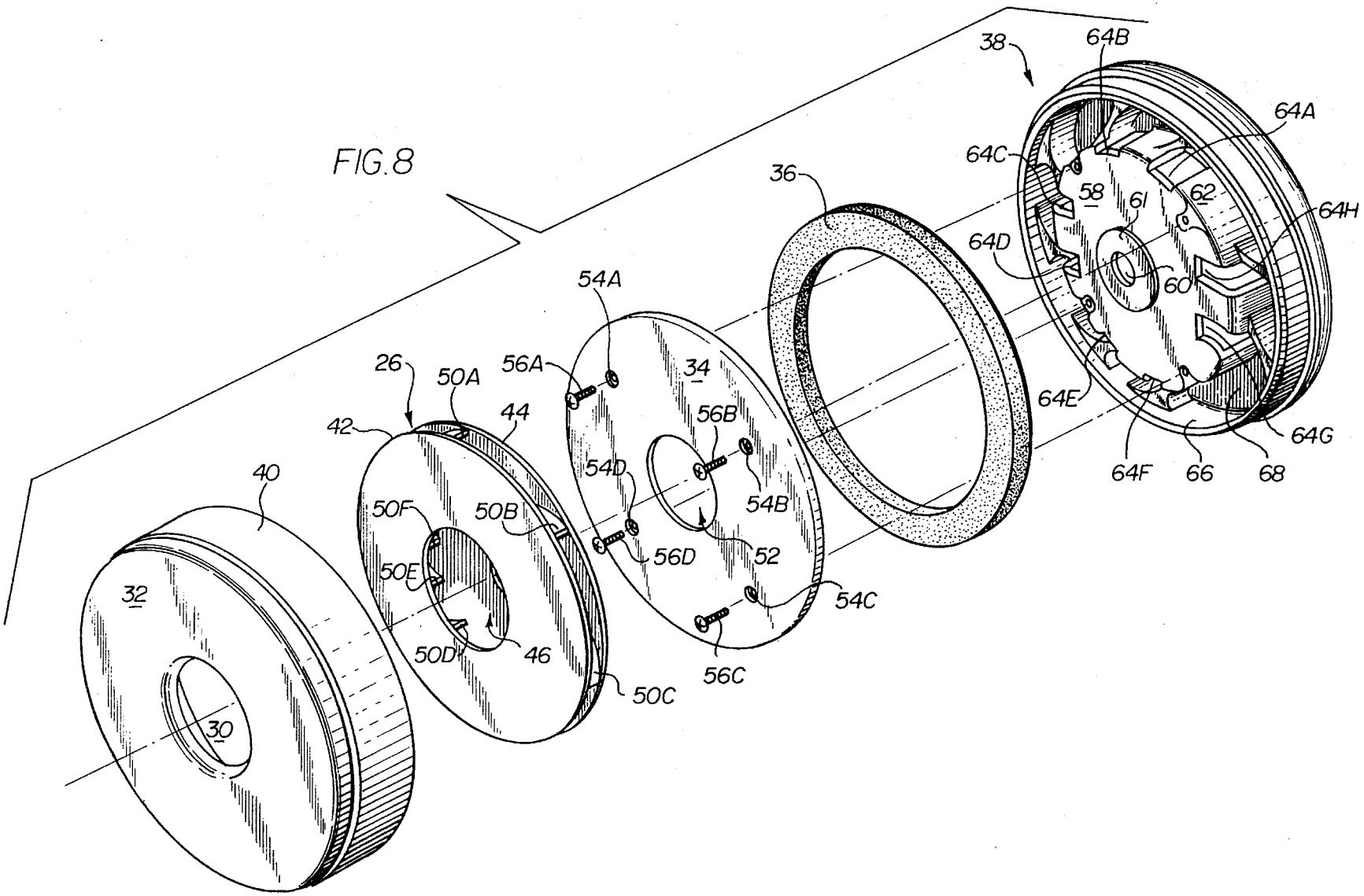
FIG. 8 is an exploded perspective view of a portion of the motor assembly of FIG. 1.

Referring now to FIG. 8, the lower housing 32 has a sidewall 40 which is secured to the upper housing 38 by means of interengaging projections and mating recesses or dimples (not depicted). The impeller 26, shown in additional detail in FIG. 5, has a lower wall 42 and an upper wall 44. Lower wall 42 has a large circular opening 46 through which air enters the impeller 26 from the opening 30 in the lower housing 32. The upper wall 44 has an opening 48 through which the spacer 27, the washers 28A–B and the nut 29 (FIG. 2) attach the drive shaft 24 to the impeller 26 for rotation. The impeller 26 has several curved vanes 50 A–F located between the lower wall 42 and upper wall 44. When the impeller 26 rotates in a counter-clockwise direction as shown in FIG. 8, air entering through the opening 46 is moved by the vanes 50A–F radially outward.

The baffle plate 34 has an opening 52 through which drive shaft 24 passes. Holes 54A–D permit screws 56A–D to pass through baffle plate 34 for attachment on the upper housing 38. The foam ring 36 is located between the baffle plate 34 and the upper housing 38. The baffle plate 34 has a diameter slightly less than the diameter of the upper housing 38 (see FIG. 2) so that air can pass around the baffle plate 34 and into the upper housing 38.

The upper housing 38 includes a main body 58 having an opening 60 surrounded by an offset ring 61 through which drive shaft 24 passes so that the drive shaft 24 is able to rotate without imparting torque to the upper housing 38. Ball bearings (not depicted) may be provided above the offset ring 61, surrounding the drive shaft 24 to facilitate the rotation of the drive shaft 24. In a sidewall 62 of the main body 58 are ports 64A–H, some of which extend well into the top portion of the main body 58. Preferably, the ports 64A–H are equal in size to optimize performance and reduce noise levels. Around the outside of the housing 38 is a rim 66 which is connected to the main body 58 by a base 68.

Figure 4:
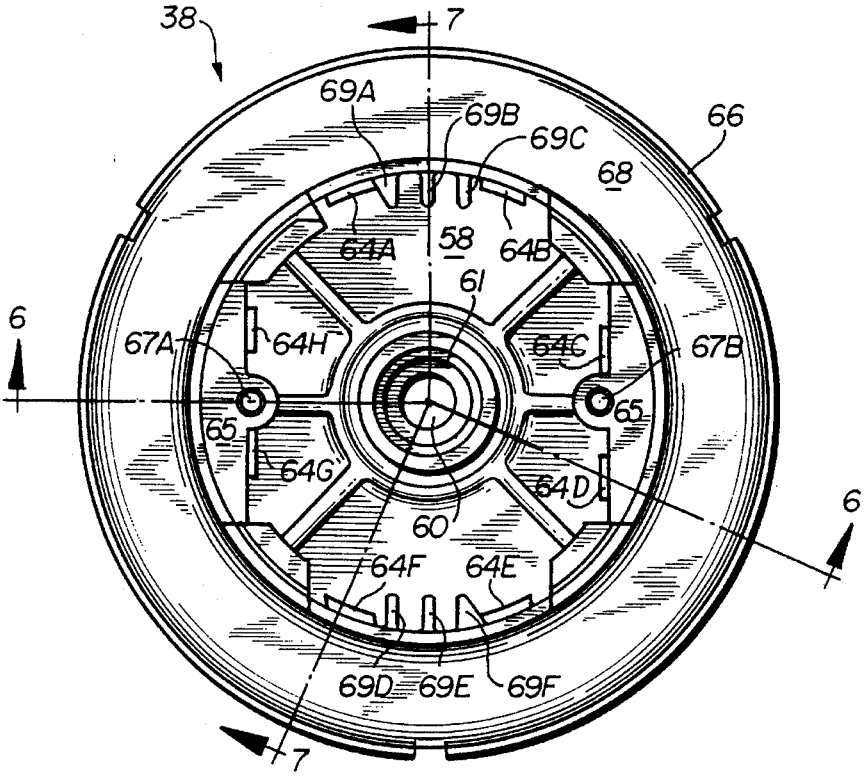
FIG. 4 is a plan view of the motor housing of FIG. 3.

As can be seen from FIG. 4, the back of upper housing 38 has a number of features on the main body 58 which provide strength or allow the upper housing 38 to attach or mate with the motor 22. Thus, the precise shape of the back of upper housing 38 will be dependent upon the motor used. Threaded openings 67A and 67B are provided to bolt the upper housing 38 to the motor 22. Baffles 65A and 65B help direct air into the center of the motor instead of allowing it to pass along the outside of the motor. In addition, the back of the upper housing 38 has six projections 69A–F which prevent air from merely spinning around in the area inside of the ports 64A–H, but instead forces the air axially into the motor 22.

Figure 3:
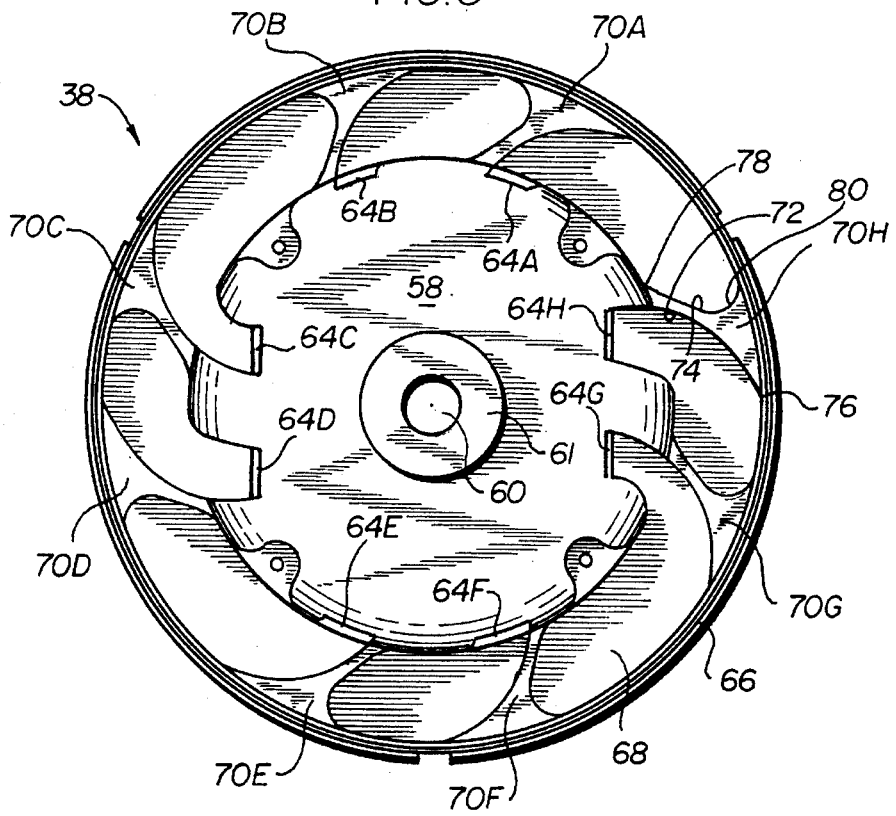
FIG. 3 is a bottom view of the motor housing of the present invention.

Referring now to FIG. 3, each port 64A–64H of upper housing 38 has a vane 70A–H associated therewith. The vanes 70A–H are not located symmetrically about the upper housing 38, but are instead placed at varying distances or angular positions about the rim 66 and the main body 58. Each vane 70A–H extends from the main body 58 to the rim 66 and is attached to the base 68. Although the vanes 70A–H are not located symmetrically about the upper housing 38, each vane has a corresponding vane located 180° around the upper housing 38, i.e., vane 70A corresponds to vane 70E, vane 70B corresponds to vane 70F, vane 70C corresponds to vane 70G, and vane 70D corresponds to vane 70H. Thus, the angle between adjacent vanes is identical to the angle between the respective corresponding adjacent vanes 180° away. Preferably, the angle between vane 70A and vane 70B or between vane 70E and vane 70F is 37°, the angle between vane 70B and vane 70C or between vane 70F and vane 70G is 58°, the angle between vane 70C and vane 70D or between vane 70G and vane 70H is 32°; and between vane 70D and vane 70E or between vane 70H and vane 70A is 53°. All angles are measured from the side of each port nearest its vane to the side of the adjacent port nearest its vane. It is believed that placing vanes in a nonsymmetrical fashion, which presents unevenly spaced obstacles for flowing air, reduces constant and even whistling, thereby reducing noise while minimizing any loss in efficiency.

Each vane 70A–70H, for example the vane 70H, has two sides, a port-facing side 72 and a back-facing side 74. The port-facing side 72 has an arcuate or curved shape so as to direct air from each vane 70A–H to its associated port 64A–H. The arcuate shape of the port-facing side 72 of each vane 70A–H allows the port-facing side 72 to intersect the rim 66 substantially tangentially at a portion 76. The substantially tangential intersection of the port-facing side 72 and the rim 66 allows air to be guided inwardly with the smoothest possible flow, which increases performance and keeps noise levels low.

The back-facing side 74 of each vane 70 does not follow the contour of the port-facing side 72, and thus each vane 70 is of varying thickness as it extends from the main body 58 to the rim 66. The back-facing side 74 of each vane 70 intersects the main body 58 with a curved surface 78 to direct air towards the port-facing side 72 of an adjacent vane. Similarly, the back-facing side 74 intersects the rim 66 with a curved surface 80 to direct air away from the back-facing side 74 and towards the port-facing side 72 of an adjacent vane. In essence, vanes of an essentially uniform thickness throughout their length have been widened at each end or have had their intersections filled in with material to replace sharp corners which would otherwise be present where the vanes meet the remainder of the housing. It is believed that sharp corners contribute to whistling or noise when air is pulled across them and may also reduce the efficiency of the lower housing 38 in allowing air to pass therethrough. In addition to the curvatures of the surface 78 and the surface 80, the back-facing side 74 may also have a gentle arcuate shape between the surface 78 and the surface 80, where the curvature is in the same direction as the curvature of the port-facing side 72.

Figure 6:
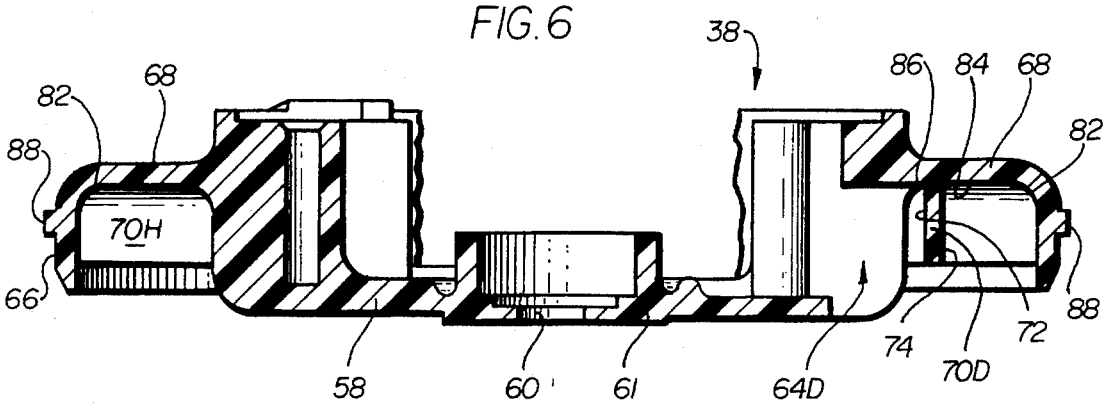
FIG. 6 is a sectional view, taken generally along the lines 6—6 of FIG. 4.
Figure 7:
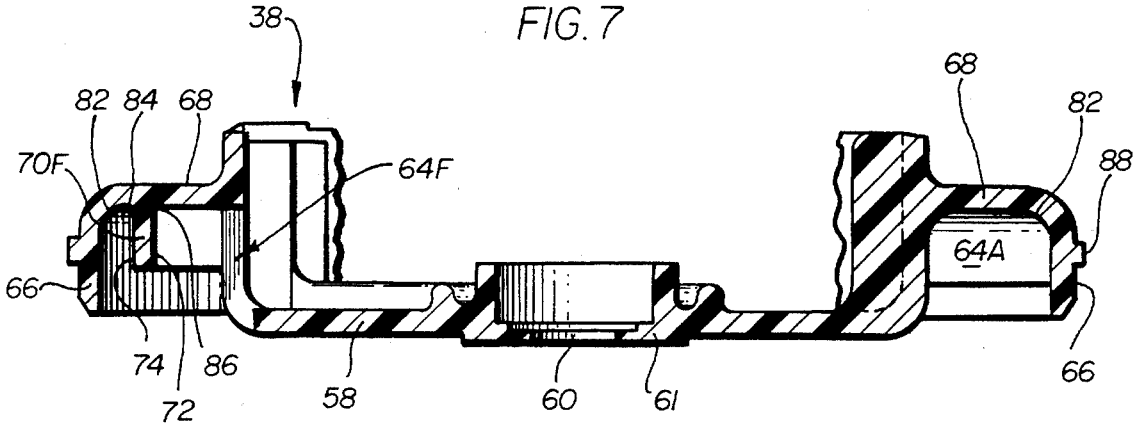
FIG. 7 is a sectional view taken generally along the lines 7—7 of FIG. 4.

Referring now to FIGS. 6 and 7, the base 68 intersects the rim 66 with a curved surface 82 to direct air away from the rim and towards an adjacent port. Similarly, the back-facing side 74 of each vane intersects the base 68 with a curved surface 84 to direct air away from the back-facing side 74. The port-facing side 72 of each vane, however, intersects the base 68 at a corner 86 which is nearly at a right angle. By providing a sharp corner, a recirculation condition, in which air flows over vanes or ports without exiting, is minimized.

The rim 66 has a flange 88 running around its perimeter to seat the lower housing 32 when it is snapped in place on the upper housing 38.

The specific size of the upper housing 38 will depend upon the amount of air to be moved and the motor with which it is used, however, the following dimensions relative to each other are suitable for an embodiment of the housing and other parts associated therewith. The diameter of the housing measured from the outside of flange 88 is 5.78 inches (14.68 cm). The diameter of the outside portion of the rim 66 is 5.64 inches (14.33 cm) with a thickness of the rim of 0.09 inches (0.23 cm). The height of the entire main body 38 is 1.10 inches (2.79 cm) and the distance from the back of the main body 38 to the top of the rim 66 is 0.97 inches (2.46 cm). The width of each port 64 is 0.40 inches (1.02 cm). The thickness of the base portion 68 is 0.12 inches (0.30 cm) and the height of each vane 70 is 0.425 inches (1.08 cm). The height of each vane 70 with respect to other elements of the lower housing 38 is particularly critical for reducing noise and increasing efficiency.

As noted above, many of the elements of the upper housing 38 are arcuate in shape or intersect other elements arcuately. Suitable radii of curvature for the elements are as follows:

| Element | Radius of Curvature |
|---|---|
| port-facing side 72 | 1.00 inch (2.54 cm) |
| back-facing side 74 | 1.07 inches (2.72 cm) |
| curved surface 78 | .50 inches (1.27 cm) |
| curved surface 80 | .22 inches (.56 cm) |
| curved surface 82 | .25 inches (.64 cm) |
| curved surface 84 | .06 inches (.15 cm) |

The upper housing 38 may be made of Plenco 1581 I, Polyester Mineral, reinforced with glass, or may be made from any other suitably rigid material such as zincs, aluminums or other plastic materials. The vanes 70A–H are preferably formed integrally with the rest of the upper housing 38 and are of the same material.

The foam ring 36 may be 0.25 inches (0.64 cm) thick, have an outside diameter of 5.40 inches (13.7 cm) and an inside diameter of 4.00 inches (10.16 cm). The foam ring 36 may be made of a ester type polyurethane foam which is reticulated and has 10 open pores per linear inch.

The lower housing 32 may have an outside diameter of 5.64 inches (14.33 cm), with a diameter of the opening 30 of 1.730 inches (4.39 cm). The overall height of the lower housing 32 may be 1.088 inches (2.76 cm) with the height from the rim of opening 30 to the top of lower housing 32 being 0.803 inches (2.04 cm). The baffle plate 34 has an overall thickness (including the curved edge portion) of 0.100 inches (0.25 cm) and a material thickness of 0.024 inches (0.06 cm). The diameter of the baffle plate 34 is 5.22 inches (12.26 cm). The impeller 26 has a total thickness of 0.29 inches (0.74 cm) with the thickness of lower wall 42 and upper wall 44 of 0.020 inches (0.051 cm). The height of each vane 50 is 0.25 inches (0.64 cm) and has a radius of curvature of 1.625 inches (4.13 cm). Opening 46 has a diameter of 1.875 inches (4.76 cm). The impeller is designed to rotate at 17,000 to 30,000 revolutions per second.

Numerous modifications and alternative embodiments of the invention will be apparent to those skilled in the art in view of the foregoing description. Accordingly, this description is to be construed as illustrative only, and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A housing for directing air to an object, the housing comprising:

a main body portion including a plurality of ports spaced about a periphery thereof;

an outer rim surrounding the main body portion;

a base portion extending between the main body portion and the outer rim; and a plurality of vanes carried on the base portion and each extending from the outer rim to one of the ports on the periphery of the main body portion wherein the vanes are spaced in a non-symmetric fashion about the main body portion.

2. The housing of claim 1 wherein there are an even number of vanes and each vane has a corresponding vane located 180° around the housing.

3. The housing of claim 2 wherein there are eight vanes.

4. The housing of claim 1 wherein:

each vane has a port-facing side; and the port-facing side is curved to direct air towards the port adjacent the vane.

5. The housing of claim 4 wherein the port-facing side of each vane intersects the base portion at a right angle.

6. The housing of claim 4 wherein the port-facing side of each vane is substantially tangent to the rim in the area where the port-facing side of the vane extends to the rim.

7. The housing of claim 1 wherein:

each vane has a back-facing side; and the back-facing side intersects the main body with a curved surface.

8. The housing of claim 1 wherein:

each vane has a back-facing side; and the back-facing side intersects the outer rim with a curved surface.

9. The housing of claim 1 wherein:

each vane has a back-facing side; and and the back-facing side intersects the base portion with a curved surface to direct air away from the back-facing side.

10. The housing of claim 1 wherein the outer rim intersects the base portion with a curved surface to direct air away from the rim.

11. The housing of claim 1 wherein the vanes are formed integrally with the main body portion, the rim and the base portion.

12. In combination with the housing of claim 1, a foam ring wherein the foam ring is placed adjacent the vanes.

13. A housing for directing air to an object, the housing comprising:

a main body portion including a plurality of ports spaced about a periphery thereof;

an outer rim surrounding the main body portion;

a base portion extending between the main body portion and the outer rim; and a plurality of vanes carried on the base portion and each extending from the outer rim to one of the ports on the periphery of the main body portion wherein each vane has a port-facing side, the port-facing side is curved to direct air towards the port adjacent the vane and the port-facing side of each vane is substantially tangent to the rim in the area where the port-facing side of the vane extends to the rim.

14. The housing of claim 13 wherein the port-facing side of each vane intersects the base portion at a right angle.

15. The housing of claim 13 wherein:

each vane has a back-facing side; and the back-facing side intersects the main body with a curved surface.

16. The housing of claim 13 wherein:

each vane has a back-facing side; and the back-facing side intersects the outer rim with a curved surface.

17. The housing of claim 13 wherein:

each vane has a back-facing side; and the back-facing side intersects the base portion with a curved surface to direct air away from the back-facing side.

18. The housing of claim 13 wherein:

the outer rim intersects the base portion with a curved surface to direct air away from the rim.

19. The housing of claim 13 wherein the vanes are formed integrally with the main body portion, the rim and the base portion.

20. In combination with the housing of claim 13, a foam ring wherein the foam ring is placed adjacent the vanes.

21. A housing for directing air to an object, the housing comprising:

a main body portion including a plurality of ports spaced about a periphery thereof;

an outer rim surrounding the main body portion;

a base portion extending between the main body portion and the outer rim; and a plurality of vanes carried on the base portion and each extending from the outer rim to one of the ports on the periphery of the main body portion wherein each vane has a port-facing side which intersects the base portion at a right angle, each vane has a back-facing side, and the back-facing side intersects the main body with a curved surface.

22. The housing of claim 21 wherein the outer rim intersects the base portion with a curved surface to direct air away from the rim.

23. A housing for directing air to an object, the housing comprising:

a main body portion including a first plurality of ports spaced about a periphery thereof;

an outer rim surrounding the main body portion;

a base portion extending between the main body portion and the outer rim; and a plurality of vanes carried on the base portion and each extending from the outer rim to one of the ports on the periphery of the main body portion wherein each vane has a back-facing side and the back-facing side intersects the outer rim with a curved surface.

24. The housing of claim 23 wherein the back-facing side intersects the base portion with a curved surface to deflect air away from the back-facing side.

25. A housing for directing air to an object, the housing comprising:

a main body portion including a plurality of ports spaced about a periphery thereof;

an outer rim surrounding the main body portion;

a base portion extending between the main body portion and the outer rim; and a plurality of vanes carried on the base portion and each extending from the outer rim to one of the ports on the periphery of the main body portion wherein:

the vanes are spaced in a non-symmetric fashion about the main body portion;

each vane has a port-facing side and a back-facing side; and the port-facing side is curved to direct air towards the port adjacent the vane;

the port-facing side of each vane intersects the base portion at a right angle;

the port-facing side of each vane is substantially tangent to the rim in the area where the port-facing side of the vane extends to therein;

the back-facing side intersects the main body with a curved surface;

the back-facing side intersects the outer rim with a curved surface;

the back-facing side intersects the base portion with a curved surface to direct air away from the back-facing side; and the outer rim intersects the base portion with a curved surface to direct air away from the rim.

* * * * *